US008884771B2

(12) United States Patent
Cooke et al.

(10) Patent No.: US 8,884,771 B2
(45) Date of Patent: Nov. 11, 2014

(54) SMOKE DETECTION USING CHANGE IN PERMITTIVITY OF CAPACITOR AIR DIELECTRIC

(75) Inventors: Benjamin T. Cooke, Denver, CO (US); Joseph Julicher, Maricopa, AZ (US); Keith Curtis, Gilbert, AZ (US)

(73) Assignee: Microchip Technology Incorporated, Chandler, AZ (US)

( * ) Notice: Subject to any disclaimer, the term of this patent is extended or adjusted under 35 U.S.C. 154(b) by 191 days.

(21) Appl. No.: 13/564,493

(22) Filed: Aug. 1, 2012

(65) Prior Publication Data

US 2014/0035753 A1 Feb. 6, 2014

(51) Int. Cl.
*G08B 21/00* (2006.01)

(52) U.S. Cl.
USPC ..... 340/628; 340/603

(58) Field of Classification Search
CPC ..... G08B 7/10; G01R 27/26
USPC ..... 340/601, 578, 628, 629, 630, 603
See application file for complete search history.

(56) References Cited

U.S. PATENT DOCUMENTS

| | | | | |
|---|---|---|---|---|
| 3,295,121 | A | 12/1966 | Scheel | 340/629 |
| 3,832,678 | A | 8/1974 | Gysell et al. | 340/587 |
| 4,213,047 | A | 7/1980 | Mccord | 250/381 |
| 4,222,045 | A * | 9/1980 | Cholin | 340/628 |
| 4,538,137 | A | 8/1985 | Kimura | 340/512 |
| 4,652,866 | A | 3/1987 | Siegmann et al. | 340/628 |
| 5,243,330 | A | 9/1993 | Thuillard | 340/629 |
| 5,422,807 | A | 6/1995 | Mitra et al. | 700/79 |
| 5,705,988 | A | 1/1998 | Mcmaster | 340/628 |
| 5,966,078 | A * | 10/1999 | Tanguay | 340/636.1 |
| 6,433,712 | B1 | 8/2002 | Ohnhacuser et al. | 341/118 |
| 6,661,346 | B1 * | 12/2003 | Wood et al. | 340/601 |
| 6,981,090 | B1 | 12/2005 | Kutz et al. | 710/317 |
| 7,307,485 | B1 | 12/2007 | Snyder et al. | 331/150 |
| 7,382,140 | B2 | 6/2008 | Obrecht | 324/678 |
| 7,460,441 | B2 | 12/2008 | Bartling | 368/118 |
| 7,764,213 | B2 | 7/2010 | Bartling et al. | 341/152 |

(Continued)

FOREIGN PATENT DOCUMENTS

| | | | |
|---|---|---|---|
| DE | 102009030495 A1 | 1/2011 | G01B 7/00 |
| EP | 1719947 A1 | 11/2006 | F23N 5/12 |

(Continued)

OTHER PUBLICATIONS

Yair, R., "Charge Sampling Method for Low Current Measurement," Review of Scientific Instruments, vol. 45, No. 3, 6 pages, Mar. 1974.

(Continued)

*Primary Examiner* — Jeffery Hofsass
(74) *Attorney, Agent, or Firm* — King & Spalding L.L.P.

(57) ABSTRACT

A capacitor having air dielectric between its plates may be used to detect the presence of smoke and other contaminants in the dielectric air passing over the plates of the capacitor. Smoke from typical fires is mainly composed of unburned carbon that has diffused in the surrounding air and rises with the heat of the fire. The permittivity of the carbon particles is about 10 to 15 times the permittivity of clean air. The addition of the carbon particles into the air creates a change in the permittivity thereof that is large enough to measure by measuring a change in capacitance of the capacitor having the air dielectric through which the air laden carbon particles pass through.

28 Claims, 6 Drawing Sheets

(a)

(b)

(56) References Cited

U.S. PATENT DOCUMENTS

| | | | | |
|---|---|---|---|---|
| 2002/0153923 | A1 | 10/2002 | Piasecki et al. | 326/57 |
| 2007/0075710 | A1 | 4/2007 | Hargreaves et al. | 324/658 |
| 2008/0272826 | A1 | 11/2008 | Smit et al. | 327/509 |
| 2008/0312857 | A1 | 12/2008 | Sequine | 702/65 |
| 2010/0102832 | A1 | 4/2010 | Bartling et al. | 324/679 |
| 2010/0181180 | A1 | 7/2010 | Peter | 200/5 R |
| 2010/0231241 | A1 | 9/2010 | Mueck et al. | 324/686 |
| 2010/0283760 | A1 | 11/2010 | Leung et al. | 345/174 |
| 2011/0007028 | A1 | 1/2011 | Curtis et al. | 345/174 |
| 2011/0267309 | A1 | 11/2011 | Hanauer et al. | 345/174 |

FOREIGN PATENT DOCUMENTS

| | | | | |
|---|---|---|---|---|
| FR | 2473201 | A1 | 7/1981 | G08B 17/11 |
| GB | 1598821 | A | 9/1981 | G08B 17/11 |
| GB | 2117560 | A | 10/1983 | G01N 27/64 |
| GB | 2156126 | A | 10/1985 | G08B 17/00 |
| WO | 2006/138205 | A1 | 12/2006 | H03M 1/06 |

OTHER PUBLICATIONS

Margarita, Andrey, "Application Note AN2245: Smart Smoke Detector," Cypress Semiconductor Corporation, XP055054690, URL: http://www.psocdeveloper.com/uploads/tx_piapappnote/an2245_01.pdf, 12 pages, Feb. 22, 2005.

Perme, Thomas, "AN1101: Introduction to Capacitive Sensing," Microchip Technology, Inc., XP002693941, URL: http://ww1.microchip.com/downloads/en/AppNotes/01101A.pdf, 10 pages, Jun. 25, 2007.

Bohn, Bruce, "AN1250: Microchip CTMU for Capacitive Touch Applications," Microchip Technology, Inc., XP055007432, URL: http://www.microchip.com/stellent/idcplg?IdcService—SS_GET_PAGE&nodeID=1824&appnote=en539441, 22 pages, Feb. 3, 2009.

Perme, Thomas et al., AN1298: Capacitive Touch Using Only an ADC ("CVD"), Microchip Technology, Inc., XP055007357, URL: http://www.microchip.com/stellent/idcplg?IdcService=SS_GET_PAGE&nodeId=1824&appnote=en545264, 4 pages, Oct. 7, 2009.

Davison, Burke, "AN1334: Techniques for Robust Touch Sensing Design," Microchip Technology, Inc., XP055047201, URL: http://www.microchip.com/downloads/en/AppNotes/01334A.pdf, 28 pages, Aug. 6, 2010.

Yedamale, Padmaraja et al., "AN1375: See What You Can Do with the CTMU," Microchip Technology, Inc., XP055047211, URL: http://www.microchip.com/downloads/en/AppNotes/CTMU%2001375a.pdf, 12 pages, May 11, 2011.

Anonymous, "Delta-Sigma Modulation," Wikipedia, URL: http://en.wikipedia.org/w/index.php?title=Special:Book&bookcmd=download&collection_id=fal36df1282a073a&writer=rl&return_to=Delta-sigma modulation, 14 pages, 2012.

International Search Report and Written Opinion, Application No. PCT/US2012/058682, 12 pages, Dec. 17, 2012.

International Search Report and Written Opinion, Application No. PCT/US2012/058691, 13 pages, Dec. 19, 2012.

International Search Report and Written Opinion, Application No. PCT/US2012/058832, 11 pages, Jan. 22, 2013.

International Search Report and Written Opinion, Application No. PCT/US2012/058837, 14 pages, Feb. 18, 2013.

International Search Report and Written Opinion, Application No. PCT/US2012/058716, 10 pages, Mar. 15, 2013.

International Search Report and Written Opinion, Application No. PCT/US2012/069086, 10 pages, Apr. 5, 2013.

International Search Report and Written Opinion, Application No. PCT/US2012/069094, 12 pages, Apr. 5, 2013.

International Search Report and Written Opinion, Application No. PCT/US2012/058688, 11 pages, Apr. 5, 2013.

International Search Report and Written Opinion, Application No. PCT/US2012/069076, 11 pages, Apr. 10, 2013.

International Search Report and Written Opinion, Application No. PCT/US2012/070466, 13 pages, Apr. 24, 2013.

International Search Report and Written Opinion, Application No. PCT/US2013/052956, 12 pages, Jan. 28, 2014.

* cited by examiner

SMOKE DETECTION USING CHANGE IN PERMITTIVITY OF CAPACITOR AIR DIELECTRIC

TECHNICAL FIELD

The present disclosure relates to smoke detection devices, and more particularly, to a smoke detection device that uses a change in permittivity of air dielectric in a sensor capacitor as smoke passes between the capacitor plates.

BACKGROUND

A smoke detector generally uses an ionization chamber containing a radioactive ion source that is coupled to a high input impedance operational amplifier. However when operating at elevated temperatures the input leakage current of the operational amplifier increases. This affects overall performance of the ionization chamber smoke detection function. Also the ionization chamber contains radioactive materials that during manufacture necessitate compliance with regulatory requirements pertaining to storing and handling of these radioactive materials. The smoke detectors having ionization chambers containing a radioactive ion source are increasingly coming under stronger government regulatory control due to the radioactive element (ion source) contained therein.

SUMMARY

Therefore, a need exists for a way to detect smoke from a fire with a smoke detector that does not require a radioactive ionization chamber as part of the smoke detection sensor.

According to an embodiment, a smoke detector using an air dielectric capacitor as a smoke sensor may comprise: an air dielectric capacitor having a plurality of plates, wherein when clean air flows over surfaces of the plurality of plates the air dielectric capacitor has a first capacitance value and when smoke is in the air flowing over the plurality of plates the air dielectric capacitor has a second capacitance value; a capacitance measurement circuit coupled to the air dielectric capacitor, wherein the capacitance measurement circuit measures a capacitance value of the air dielectric capacitor; and an alarm circuit coupled to the capacitance measurement circuit, wherein when the measured capacitance value is at substantially the second capacitance value the alarm circuit is actuated by the capacitance measurement circuit, and when the measured capacitance value is at substantially the first capacitance value the alarm circuit is not actuated.

According to a further embodiment, the second capacitance value is greater than the first capacitance value. According to a further embodiment, there is a time limit for the air dielectric capacitor to change from the first capacitance value to the second capacitance value, otherwise the alarm circuit will not actuate. According to a further embodiment, the capacitance measurement circuit is a charge time measurement unit (CTMU) circuit. According to a further embodiment, the alarm circuit has a shutdown circuit. According to a further embodiment, a digital processor is coupled to the capacitance measurement circuit and the alarm circuit. According to a further embodiment, the digital processor is a microcontroller. According to a further embodiment, the capacitance measurement circuit, the alarm circuit and the digital processor are fabricated on an integrated circuit die.

According to a further embodiment, a temperature sensor is coupled to the digital processor and a temperature compensation look-up table is stored in a memory coupled to the digital processor and used to compensate temperature induced changes of the first and second capacitance values. According to a further embodiment, a humidity sensor is coupled to the digital processor and a humidity compensation look-up table is stored in a memory that is coupled to the digital processor and used to compensate humidity induced changes of the first and second capacitance values. According to a further embodiment, an audible alert is actuated by the alarm circuit. According to a further embodiment, a visual alert is actuated by the alarm circuit.

According to another embodiment, a smoke detector using an air dielectric capacitor as a smoke sensor may comprise: an air dielectric capacitor having a plurality of plates, wherein when clean air flows over surfaces of the plurality of plates the air dielectric capacitor has a first capacitance value and when smoke is in the air flowing over the plurality of plates the air dielectric capacitor has a second capacitance value; a capacitance change detection circuit coupled to the air dielectric capacitor, wherein the capacitance change detection circuit determines when the air dielectric capacitor changes from the first capacitance value to the second capacitance value; and an alarm circuit coupled to the capacitance change detection circuit, wherein when the capacitance change detection circuit indicates that the first capacitance value has changed to the second capacitance value the alarm circuit is actuated, otherwise the alarm circuit is not actuated.

According to a further embodiment, the second capacitance value is greater than the first capacitance value. According to a further embodiment, the capacitance change detection circuit further comprises a time limit for the air dielectric capacitor to change from the first capacitance value to the second capacitance value, otherwise the alarm circuit will not actuate. According to a further embodiment, the capacitance change detection circuit is a capacitive voltage divider (CVD) circuit. According to a further embodiment, the capacitance change detection circuit is a capacitive sensing module (CSM) circuit.

According to a further embodiment, the capacitance change detection circuit may comprise: a frequency generation circuit using the air dielectric capacitor as part of a frequency determining circuit thereof; and a frequency discriminator circuit coupled to the frequency generation circuit, the frequency discriminator circuit has a first output when the air dielectric capacitor is at the first capacitance value and has a second output when the air dielectric capacitor is at the second capacitance value. According to a further embodiment, the alarm circuit further comprises a shutdown circuit.

According to a further embodiment, a digital processor is coupled to the capacitance change detection circuit and the alarm circuit. According to a further embodiment, the digital processor is a microcontroller. According to a further embodiment, the capacitance change detection circuit, the alarm circuit and the digital processor are fabricated on an integrated circuit die. According to a further embodiment, a temperature sensor is coupled to the digital processor and a temperature compensation look-up table stored in a memory coupled to the digital processor and used to compensate temperature induced changes of the first and second capacitance values. According to a further embodiment, a humidity sensor is coupled to the digital processor and a humidity compensation look-up table is stored in a memory coupled to the digital processor and used to compensate humidity induced changes of the first and second capacitance values. According to a further embodiment, an audible alert is actuated by the alarm circuit. According to a further embodiment, a visual alert is actuated by the alarm circuit.

According to still another embodiment, a method for detecting smoke in air may comprise the steps of: flowing clean air over a plurality of plates of an air dielectric capacitor; determining a capacitance value of the air dielectric capacitor when the clean air is flowing over the plurality of the plates of the air dielectric capacitor; detecting an increase in the capacitance value of the air dielectric capacitor indicating smoke in the flowing air; and generating a smoke alarm when the increase in the capacitance value of the air dielectric capacitor is detected.

According to yet another embodiment, a method for detecting smoke in air may comprise the steps of: flowing air over a plurality of plates of an air dielectric capacitor; detecting when an increase in a capacitance value of the air dielectric capacitor occurs, thereby indicating smoke in the flowing air; and generating a smoke alarm when the increase in the capacitance value of the air dielectric capacitor is detected.

BRIEF DESCRIPTION OF THE DRAWINGS

A more complete understanding of the present disclosure may be acquired by referring to the following description taken in conjunction with the accompanying drawings wherein.

Figure 1:
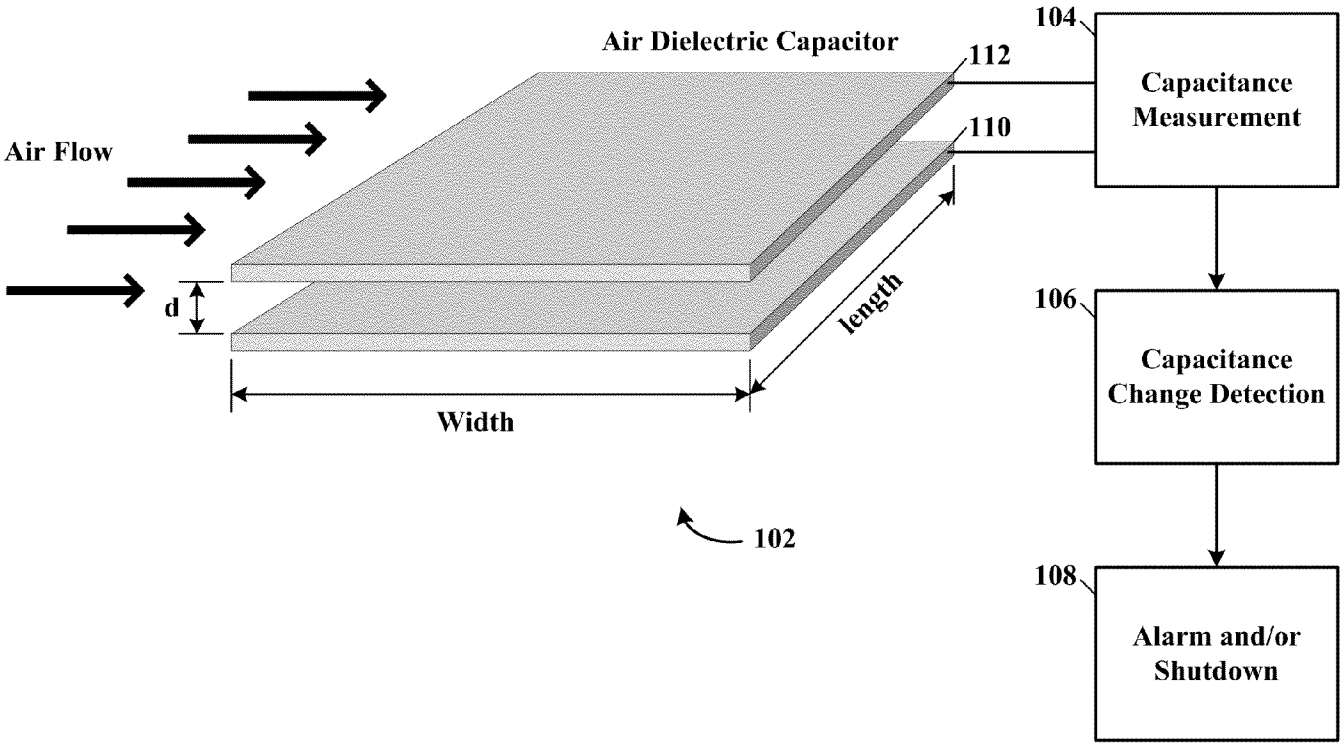
FIG. 1 illustrates a schematic block diagram of smoke detection apparatus using an air dielectric capacitor as a smoke sensor, according to the teachings of this disclosure.

While the present disclosure is susceptible to various modifications and alternative forms, specific example embodiments thereof have been shown in the drawings and are herein described in detail. It should be understood, however, that the description herein of specific example embodiments is not intended to limit the disclosure to the particular forms disclosed herein, but on the contrary, this disclosure is to cover all modifications and equivalents as defined by the appended claims.

DETAILED DESCRIPTION

A capacitor having air dielectric between its plates may be used to detect the presence of smoke and other contaminants in the dielectric air passing over the plates of the capacitor, according to the teachings of this disclosure. Smoke from typical fires is mainly composed of unburned carbon that has diffused in the surrounding air and rises with the heat of the fire. The permittivity of the carbon particles is about 10 to 15 times the permittivity of clean air. The addition of the carbon particles into the air creates a change in the permittivity thereof that is large enough to measure by measuring a change in capacitance of the capacitor having the air dielectric through which the air laden carbon particles pass through. For example, even a small concentration of carbon particles in air, e.g., 400 PPM, will cause the permittivity to change from about 1.00054 (clean air) to about 1.00494, thereby increasing the capacitance of a 22 picofarad capacitor by about 0.44 percent (0.0967 picofarads=96.7 femtofarads).

Humidity and temperature variations can make significant changes to the permittivity of air, but may be compensated for with external humidity and temperature sensors. Permittivity variations due to environmental humidity and temperature changes generally are over a longer time period than a sudden change in the amount of contaminates (carbon particles, etc.) in the air between the plates of the capacitor. Therefore an envelope detection or averaging process may be used to ignore the slow drift of capacitance due to humidity and/or temperature changes but recognize a more abrupt (rapid) change of the permittivity of air due to carbon particles suddenly showing up in the air dielectric of the sensor capacitor. Various techniques for measuring changes in capacitance may be used and are contemplated herein for all purposes. Those having ordinary skill in capacitor measurement circuits and the benefit of this disclosure could readily apply those capacitor measurement circuits in a smoke detection apparatus.

Referring now to the drawing, the details of specific example embodiments are schematically illustrated. Like elements in the drawings will be represented by like numbers, and similar elements will be represented by like numbers with a different lower case letter suffix.

Referring to FIG. 1, depicted is a schematic block diagram of smoke detection apparatus using an air dielectric capacitor as a smoke sensor, according to the teachings of this disclosure. An air dielectric capacitor, generally represented by the numeral 102, comprises a first conductive plate 110, a second conductive plate 112 and an insulated air dielectric therebetween. The capacitor 102 may be made from metal plates, conductive foil covered printed circuit boards, etc. A capacitance measurement circuit 104 is coupled to the first and second conductive plates 110 and 112, respectively, and is used to determine a capacitance value of the capacitor 102 caused by a change in the permittivity of the air dielectric between the first and second conductive plates 110 and 112. A capacitive change detection circuit 106 may be used to detect a change in the capacitance as measured by the capacitance measurement circuit 104. An alarm and/or shutdown circuit 108 may be coupled to the capacitive change detection circuit 106 and be adapted to alarm and/or shutdown equipment, e.g., audible and visual alerts, shutdown an air handler blower, etc.

The capacitance, C, of the capacitor 102 is a function of the area, A=length×width, of the conductive plates 110 and 112, the distance, d, between the plates 110 and 112 facing each other, and the permittivity, $\epsilon$, of the dielectric (air) therebetween according to the formula: $C=\epsilon A/d$. As multiple plates are added (see FIGS. 2 and 3), the capacitance increases proportionally, e.g., $C=\epsilon A/d*(\#\text{ plates }-1)$. Preferably the capacitor 102 may have a capacitance value within an accurate capacitance measurement resolution range of the capacitance measurement circuit 104. The capacitor 102 may also be physically configured, e.g., number of plates, plate separation, shape, etc., for a specific application, e.g., return air duct mounted (FIG. 2), ceiling mounted smoke alarm (FIG. 3), etc.

The capacitance measurement circuit 104 may be any one or more capacitance measurement circuit that have the necessary capacitance resolution. For example, but not limited to, a Charge Time Measurement Unit (CTMU) may be used for very accurate capacitance measurements. The CTMU is more fully described in Microchip applications notes AN1250 and AN1375, available at www.microchip.com, and commonly owned U.S. Pat. No. 7,460,441 B2, entitled "Measuring a long time period;" and U.S. Pat. No. 7,764,213 B2, entitled "Current-time digital-to-analog converter," both by James E. Baffling; wherein all of which are hereby incorporated by reference herein for all purposes.

Also the capacitance measurement circuit 104 and the capacitive change detection circuit 106 may be combined as a circuit to just detect a change in capacitance of the capacitor 102. For example, a Capacitive Voltage Divider (CVD) circuit may be used according to AN1298, available at www.microchip.com, and commonly owned U.S. Patent Application Publication No.: US 2010/0181180 A1, entitled "Capacitive Touch Sensing Using an Internal Capacitor of an Analog-to-Digital Converter (ADC) and a Voltage Reference" by Dieter Peter. A Capacitive Sensing Module (CSM) circuit may be used according to AN1171, AN1312 and AN1334, available at www.microchip.com, and commonly owned U.S. Patent Application No.: US 2011/0007028 A1, entitled "Capacitive Touch System With Noise Immunity" by Keith E. Curtis, et al.; wherein all of which are hereby incorporated by reference herein for all purposes.

Another capacitive change detection circuit may be a tuned circuit using the capacitor 102 as one of the frequency determining elements and a frequency discriminator circuit, as more fully described in commonly owned U.S. Patent Application Publication No.: US 2008/0272826 A1, entitled "Interrupt/Wake-Up of an Electronic Device in a Low Power Sleep Mode When Detecting a Sensor or Frequency Source Activated Frequency Change" by Zacharias Marthinus Smit, et al., and is hereby incorporated by reference herein for all purposes.

Figure 2:
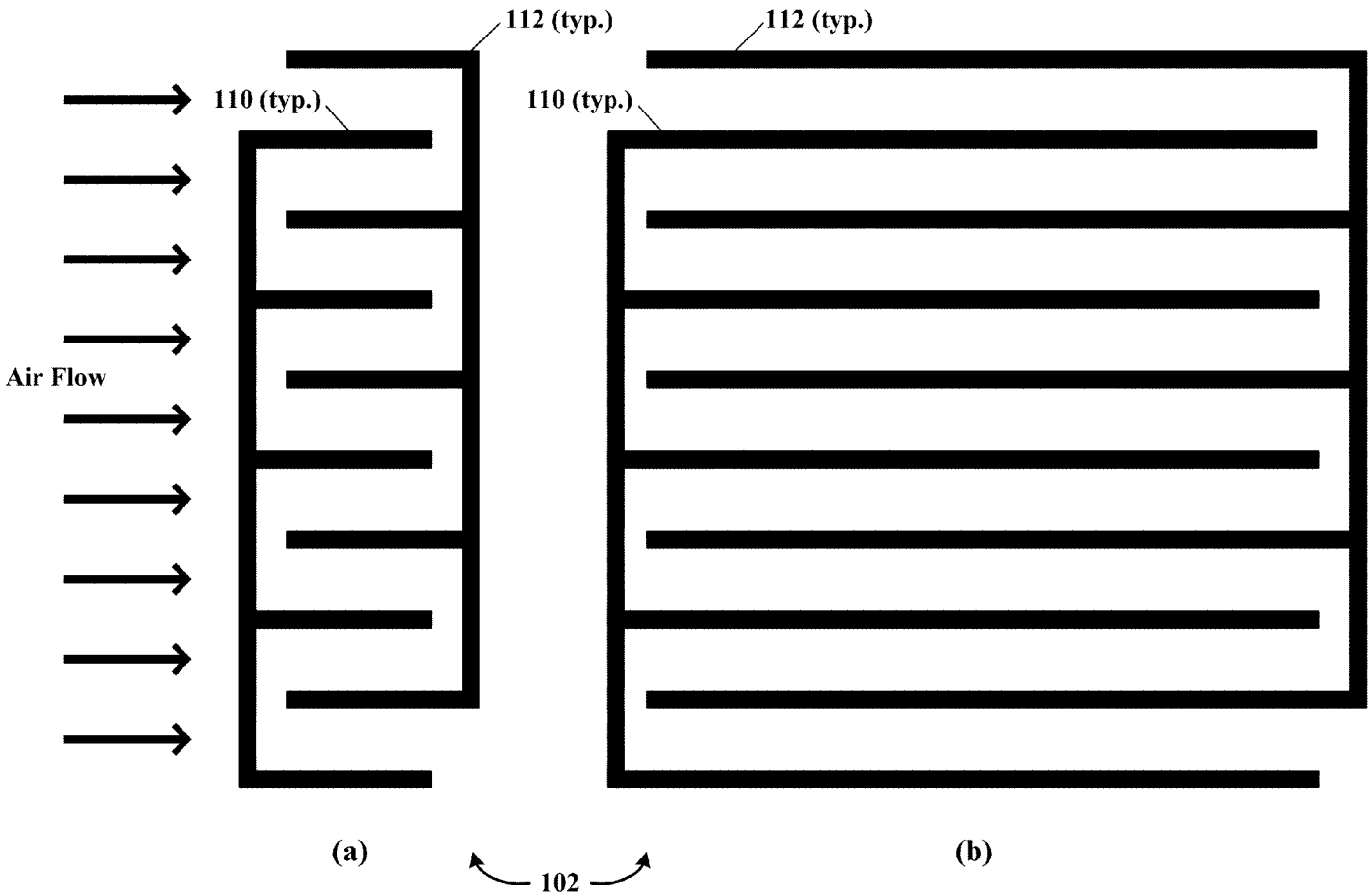
FIG. 2 illustrates schematic side and front elevational views of an air dielectric capacitor used as a smoke sensor in a return air plenum, according to a specific example embodiment of this disclosure.

Referring now to FIG. 2, depicted are schematic side and front elevational views of an air dielectric capacitor used as a smoke sensor in a return air plenum, according to a specific example embodiment of this disclosure. FIG. 2(*a*) depicts the side elevational view of a multi-plate air dielectric capacitor 102 showing air flow direction over and through the plates. FIG. 2(*b*) depicts the front elevational view of the multi-plate air dielectric capacitor 102 where air flow goes into the front of the multi-plate air dielectric capacitor 102. This physical configuration can be easily adapted to fit inside of an air supply and/or return plenum (not shown), or at the return or supply register (not shown). The plates 110 and 112 of the capacitor 102 may be metal or any other conductive material, e.g., conductive foil covered printed circuit boards.

Figure 3:
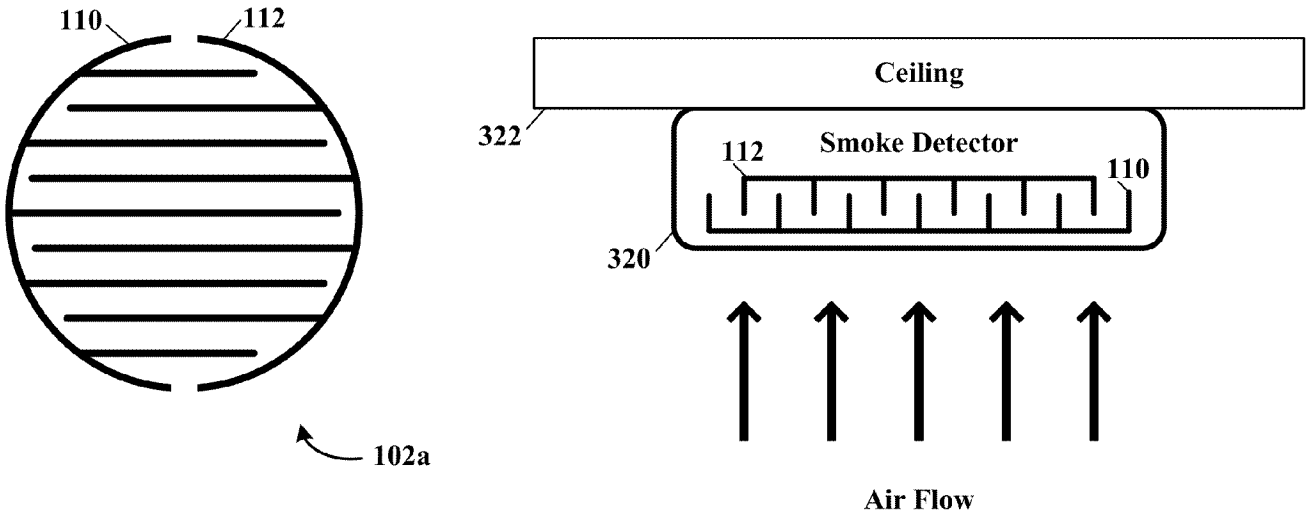
FIG. 3 illustrates a schematic front view and a schematic elevational view of an air dielectric capacitor used as a smoke sensor in a ceiling mounted smoke detector, according to another specific example embodiment of this disclosure.

Referring now to FIG. 3, depicted are a schematic front view and a schematic elevational view of an air dielectric capacitor used as a smoke sensor in a ceiling mounted smoke detector, according to another specific example embodiment of this disclosure. FIG. 3(*a*) depicts the front view of a multi-plate air dielectric capacitor 102*a* that may be used in a ceiling mounted smoke detector 320. FIG. 3(*b*) depicts the elevational view of the multi-plate air dielectric capacitor 102*a* in a smoke detector 320 mounted under a ceiling 322, showing air flow into the front lower portion of the smoke detector 320 where the multi-plate air dielectric capacitor 102*a* is located. As the heat and smoke from the fire rises, the smoke flows through the plates 110 and 112 of the smoke sensor capacitor 102*a*. This physical configuration for the smoke detector capacitor 102*a* may be adapted to fit inside any of the common smoke detectors used in residential and commercial buildings. The plates 110 and 112 of the capacitor 102*a* may be metal or any other conductive material, e.g., conductive foil covered printed circuit boards.

Figure 4:
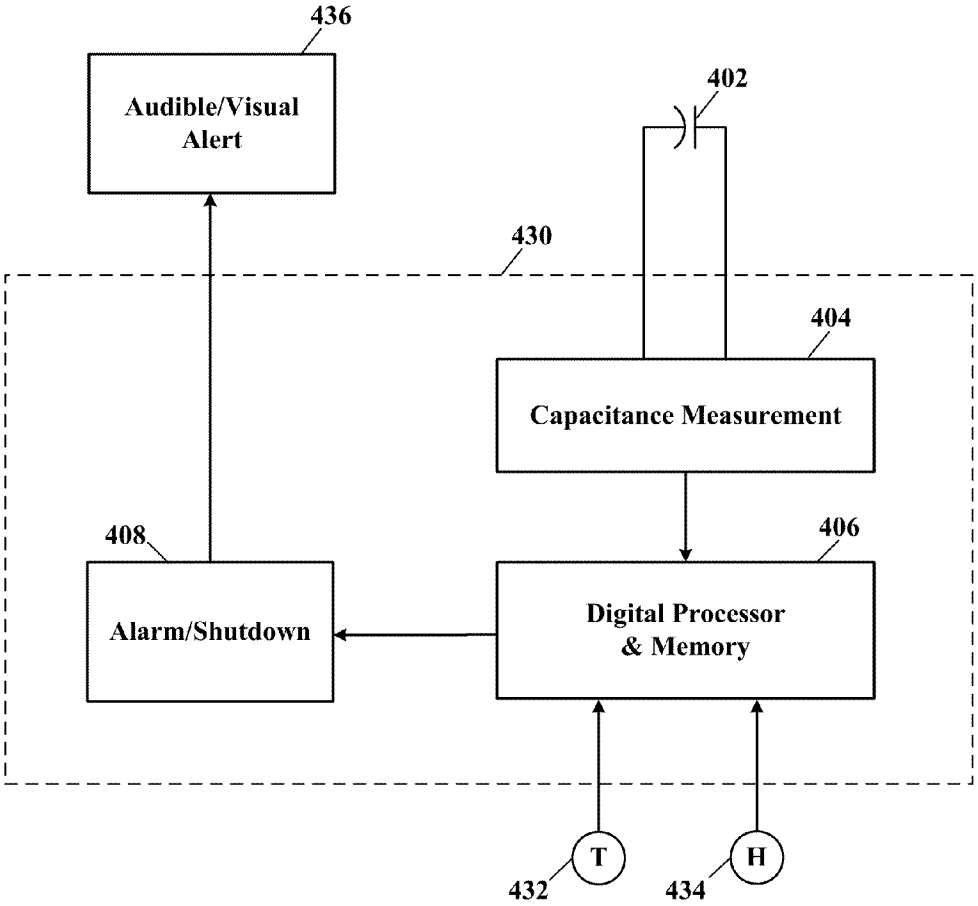
FIG. 4 illustrates a schematic block diagram of a smoke detection system, according to yet another specific example embodiment of this disclosure.

Referring now to FIG. 4, depicted is a schematic block diagram of a smoke detection system, according to yet another specific example embodiment of this disclosure. The smoke detection system may comprise a capacitance measurement circuit 404 and/or a capacitance change detection circuit 106 coupled to a digital processor and memory 406. An alarm/shutdown driver(s) 408 coupled to an output(s) of the digital processor and memory 406 may be used to drive an audible and/or visual alert signal. The alarm/shutdown driver 408 may also drive a shutdown circuit in the application of an air handler blower pushing air into a plenum where the smoke detector may be located. The smoke detector capacitor 402 is coupled to the capacitance measurement circuit 404 or the capacitance change detection circuit 106 having a capacitance measurement circuit 404 incorporated therein.

The digital processor 406 may further be coupled to temperature and/or humidity sensors 432 and 434, respectively, and have some type of compensation means to adjust the capacitance measurements that may change under different temperature and humidity conditions, e.g., using look-up tables that contain calibration and compensation data for the smoke sensor capacitor 402. In addition, the digital processor 406 may have smoothing, time averaging, noise suppression, over sampling, and/or digital signal processing to enhance the capacitance change detection sensitivity and/or reduce noise pick-up. The capacitance measurement circuit 404, the digital processor and memory 406, and the alarm/shutdown driver(s) 408 may be fabricated on an integrated circuit die 430. The integrated circuit die 430 may be encapsulated in an integrated circuit package (not shown).

The digital processor 406 may be, for example but is not limited to, a microcontroller, a microprocessor, a digital signal processor (DSP), a programmable logic array (PLA), an application specific integrated circuit (ASIC), etc. The memory may be volatile and/or non-volatile memory. A software and/or firmware operating program, and temperature and/or humidity compensation table(s) may be stored in the memory coupled to the digital processor 406. The temperature and/or humidity compensation table(s) may be defined during testing of the integrated circuit device 430 by measuring the capacitance or change thereof and correlating any changes to that capacitance as a function of temperature and/or humidity.

Figure 5:
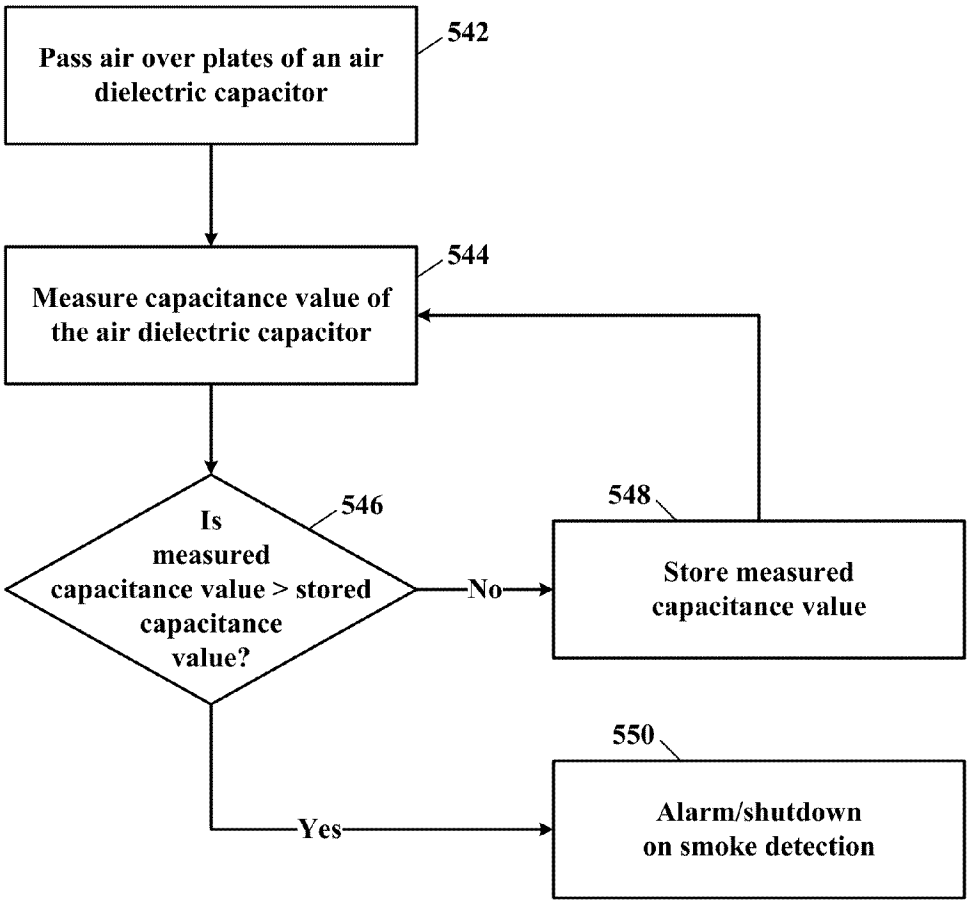
FIG. 5 illustrates a schematic flow diagram of a smoke detection system, according to still another specific example embodiment of this disclosure.

Referring to FIG. 5, depicted is a schematic flow diagram of a smoke detection system, according to still another specific example embodiment of this disclosure. In step 542 air is passed over plates of an air dielectric capacitor. In step 544 a capacitance value is measured for the air dielectric capacitor. In step 546 a determination is made whether the measured capacitance value is greater than a stored capacitance value determined previously. If the presently measured capacitance value is about the same value as the stored capacitance value then the presently measured capacitance is stored in step 548, then step 544 is repeated and a new capacitance value is measure. However, if the presently measured capacitance value is greater than the stored capacitance value then a smoke alarm is generated in step 550.

Figure 6:
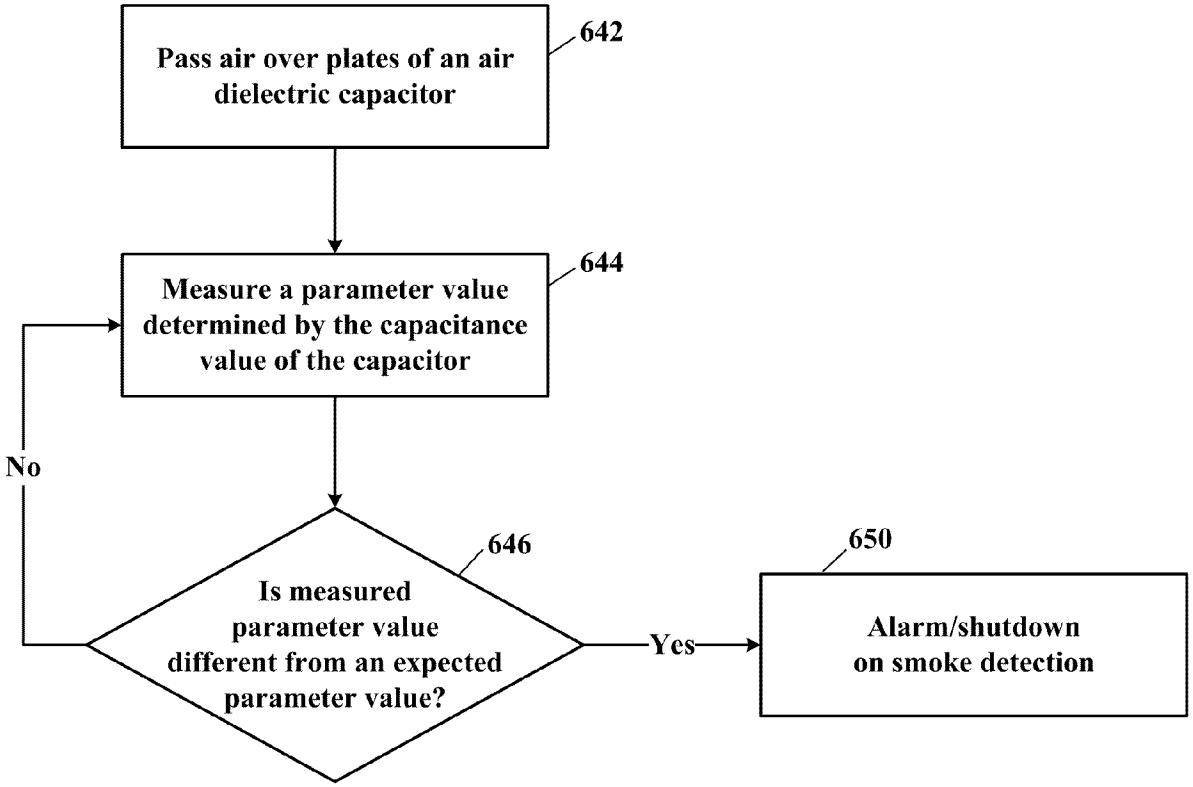
FIG. 6 illustrates a schematic flow diagram of a smoke detection system, according to yet another specific example embodiment of this disclosure.

Referring to FIG. 6, depicted is a schematic flow diagram of a smoke detection system, according to yet another specific example embodiment of this disclosure. In step 642 air is passed over plates of an air dielectric capacitor. In step 644 a parameter value is determined by the capacitance of the air dielectric capacitor. In step 646 a determination is made whether the parameter value is greater than an expected parameter value. If the parameter value is about the same value as the expected parameter value then step 644 is repeated and a new parameter value is measure. However, if the presently measured parameter value is different then the expected parameter value then a smoke alarm is generated in step 650.

While embodiments of this disclosure have been depicted, described, and are defined by reference to example embodiments of the disclosure, such references do not imply a limitation on the disclosure, and no such limitation is to be inferred. The subject matter disclosed is capable of considerable modification, alteration, and equivalents in form and function, as will occur to those ordinarily skilled in the pertinent art and having the benefit of this disclosure. The depicted and described embodiments of this disclosure are examples only, and are not exhaustive of the scope of the disclosure.

What is claimed is:

1. A smoke detector using an air dielectric capacitor as a smoke sensor, said smoke detector comprising:

an air dielectric capacitor having a plurality of plates, wherein the plates are arranged such that an inter-digital structure is formed between the plates, wherein when clean air flows over surfaces of the inter-digital structure the air dielectric capacitor has a first capacitance value and when smoke is in the air flowing over the inter-digital structure the air dielectric capacitor has a second capacitance value;

a capacitance measurement circuit coupled to the air dielectric capacitor, wherein the capacitance measurement circuit measures a capacitance value of the air dielectric capacitor; and an alarm circuit coupled to the capacitance measurement circuit, wherein when the measured capacitance value is at substantially the second capacitance value the alarm circuit is actuated by the capacitance measurement circuit, and when the measured capacitance value is at substantially the first capacitance value the alarm circuit is not actuated.

2. The smoke detector according to claim 1, wherein the second capacitance value is greater than the first capacitance value.

3. The smoke detector according to claim 1, wherein the capacitance change measurement circuit further comprises a time limit for the air dielectric capacitor to change from the first capacitance value to the second capacitance value, otherwise the alarm circuit will not actuate.

4. The smoke detector according to claim 1, wherein the capacitance measurement circuit is a charge time measurement unit (CTMU) circuit.

5. The smoke detector according to claim 1, wherein the alarm circuit further comprises a shutdown circuit.

6. The smoke detector according to claim 1, further comprising a digital processor coupled to the capacitance measurement circuit and the alarm circuit, wherein the digital processor is a microcontroller, and wherein the capacitance measurement circuit, the alarm circuit and the digital processor are fabricated on an integrated circuit die.

7. A smoke alarm system comprising an integrated circuit device according to claim 1, wherein the air dielectric capacitor is mounted within a return air plenum.

8. The smoke detector according to claim 1, wherein the air dielectric capacitor comprises two outer semi-circle shaped shells arranged at a distance to form a circle, wherein from an inner surface of each shell fingers extend alternatingly such that the inter-digital structure is formed.

9. The smoke detector according to claim 6, further comprising a temperature sensor coupled to the digital processor and a temperature compensation look-up table stored in a memory coupled to the digital processor and used to compensate temperature induced changes of the first and second capacitance values.

10. The smoke detector according to claim 6, further comprising a humidity sensor coupled to the digital processor and a humidity compensation look-up table stored in a memory coupled to the digital processor and used to compensate humidity induced changes of the first and second capacitance values.

11. The smoke detector according to claim 1, further comprising an audible alert actuated by the alarm circuit.

12. The smoke detector according to claim 1, further comprising a visual alert actuated by the alarm circuit.

13. A smoke detector using an air dielectric capacitor as a smoke sensor, said smoke detector comprising:

an air dielectric capacitor having a plurality of plates, wherein the plates are arranged such that an inter-digital structure is formed between the plates, wherein when clean air flows over surfaces of the plurality of plates the air dielectric capacitor has a first capacitance value and when smoke is in the air flowing over the plurality of plates the air dielectric capacitor has a second capacitance value;

a capacitance change detection circuit coupled to the air dielectric capacitor, wherein the capacitance change detection circuit determines when the air dielectric capacitor changes from the first capacitance value to the second capacitance value; and an alarm circuit coupled to the capacitance change detection circuit, wherein when the capacitance change detection circuit indicates that the first capacitance value has changed to the second capacitance value the alarm circuit is actuated, otherwise the alarm circuit is not actuated.

14. The smoke detector according to claim 13, wherein the second capacitance value is greater than the first capacitance value.

15. The smoke detector according to claim 13, wherein the capacitance change detection circuit further comprises a time limit for the air dielectric capacitor to change from the first capacitance value to the second capacitance value, otherwise the alarm circuit will not actuate.

16. The smoke detector according to claim 13, wherein the capacitance change detection circuit is a capacitive voltage divider (CVD) circuit.

17. The smoke detector according to claim 13, wherein the capacitance change detection circuit is a capacitive sensing module (CSM) circuit.

18. The smoke detector according to claim 13, wherein the capacitance change detection circuit comprises:

a frequency generation circuit using the air dielectric capacitor as part of a frequency determining circuit thereof; and a frequency discriminator circuit coupled to the frequency generation circuit, the frequency discriminator circuit has a first output when the air dielectric capacitor is at the first capacitance value and has a second output when the air dielectric capacitor is at the second capacitance value.

19. The smoke detector according to claim 13, wherein the alarm circuit further comprises a shutdown circuit.

20. The smoke detector according to claim 13, further comprising a digital processor coupled to the capacitance change detection circuit and the alarm circuit, wherein the digital processor is a microcontroller and wherein the capacitance change detection circuit, the alarm circuit and the digital processor are fabricated on an integrated circuit die.

21. A smoke alarm system comprising a smoke detector according to claim 20, wherein the air dielectric capacitor is mounted within a return air plenum.

22. The smoke detector according to claim 13, wherein the air dielectric capacitor comprises two outer semi-circle shaped shells arranged at a distance to form a circle, wherein from an inner surface of each shell fingers extend alternatingly such that the inter-digital structure is formed.

23. The smoke detector according to claim 20, further comprising a temperature sensor coupled to the digital processor and a temperature compensation look-up table stored in a memory coupled to the digital processor and used to compensate temperature induced changes of the first and second capacitance values.

24. The smoke detector according to claim 20, further comprising a humidity sensor coupled to the digital processor and a humidity compensation look-up table stored in a memory coupled to the digital processor and used to compensate humidity induced changes of the first and second capacitance values.

25. The smoke detector according to claim 13, further comprising an audible alert actuated by the alarm circuit.

26. The smoke detector according to claim 13, further comprising a visual alert actuated by the alarm circuit.

27. A method for detecting smoke in air, said method comprising the steps of:

flowing clean air over a plurality of plates of an air dielectric capacitor, wherein the plates are arranged such that an inter-digital structure is formed between the plates;

determining a capacitance value of the air dielectric capacitor when the clean air is flowing over the plurality of the plates of the air dielectric capacitor;

detecting an increase in the capacitance value of the air dielectric capacitor indicating smoke in the flowing air; and generating a smoke alarm when the increase in the capacitance value of the air dielectric capacitor is detected.

28. A method for detecting smoke in air, said method comprising the steps of:

flowing air over a plurality of plates of an air dielectric capacitor, wherein the plates are arranged such that an inter-digital structure is formed between the plates;

detecting when an increase in a capacitance value of the air dielectric capacitor occurs, thereby indicating smoke in the flowing air; and generating a smoke alarm when the increase in the capacitance value of the air dielectric capacitor is detected.

* * * * *